United States Patent [19]

Colvin

[11] Patent Number: 5,058,278

[45] Date of Patent: Oct. 22, 1991

[54] SELF DEFENSE WEAPON

[76] Inventor: Thomas C. Colvin, 17703 Bremer Rd., Fort Wayne, Ind. 46774

[21] Appl. No.: 557,368

[22] Filed: Jul. 24, 1990

[51] Int. Cl.[5] ..... B26B 29/00; B26B 27/00; B26B 3/00

[52] U.S. Cl. ..... 30/298; 30/289; 30/299

[58] Field of Search ..... 30/272.1, 273, 288, 30/289, 290, 298, 299, 302, 303, 304

[56] References Cited

U.S. PATENT DOCUMENTS

| | | | |
|---|---|---|---|
| D. 136,910 | 12/1943 | Cosneck | 30/298 |
| 1,315,503 | 9/1919 | Hughes | 30/298 |
| 4,543,721 | 10/1985 | Smith | 30/299 |

*Primary Examiner*—Douglas D. Watts

*Assistant Examiner*—Paul M. Heyrana, Sr.

*Attorney, Agent, or Firm*—Roger M. Rickert

[57] ABSTRACT

A self defense weapon comprising a glove type mounting of three groups of projecting spikes for slashing and stabbing an opponent. A first group of spikes is directed forward for stabbing. A second group of spikes is mounted to pivot between a first position wherein they are directed forward when the mechanism is not in use and a second position wherein the second spikes extend substantially perpendicular to the first spikes. A third group of spikes are retracted into a handle of the mechanism when it is not in use and are released to extend in a lateral direction during use. An actuator causes the third spikes to become extended and simultaneously causes the second spikes to be rotated to the second position.

8 Claims, 3 Drawing Sheets

SELF DEFENSE WEAPON

TECHNICAL FIELD

The invention relates to self defense weapons and more particularly to a glove type mounting of sharpened pins or spikes for self defense.

BACKGROUND ART

Various manual weapons are used in the martial arts for self defense. Weapons such as knives, daggers, swords, rods, darts and the like have been used for many centuries for self defense. Of these, a knife or a dagger is probably the most suitable weapon for use in close quarters. The knife and dagger may be used both for stabbing and for slashing. Knifes and daggers have the disadvantage that they must be grasped tightly during an encounter. If the user's grip should loosen, the knife may slip or may be dropped. Further, knifes and daggers have only a single point. If the point misses its target, the opponent may not be stopped and the user is at risk of being injured by a counter attack from the opponent.

DISCLOSURE OF INVENTION

According to the invention, a self defense weapon is provided in the form of a glove type mechanism mounting a plurality of sharp spikes. The spikes are spaced to minimize the need for accuracy when defending against an attacker. One group of spikes are permanently secured to the mechanism to point in a forward direction as an extension of the user's arm. A second group of spikes are mounted on a pivotable member. The second group of spikes may be moved between a first position wherein they are directed forward with the first group of spikes and a second position wherein they are directed at substantially 90 degrees to the first group of spikes. A third group of spikes which are normally retracted in the handle of the mechanism may be manually released and springs cause the third spikes to project from the glove in a direction lying substantially 90 degrees to the first and second groups of spikes. When the third group of spikes are manually released, the second group of spikes are simultaneously released and are pivoted by a spring from the first position to the second position.

For safety when the weapon is worn but not in use, the first and second spikes are all directed forward and the third spikes are retracted. When the user squeezes an actuator, the spikes are all moved to the use position. By having spikes project from the mechanism at different directions during use, the mechanism is particularly suitable for close quarter self defense which may require both stabbing and slashing. Further, the glove type mounting eliminates the risk of dropping or slipping which was present with a knife or dagger. The glove type mounting may be secured to the users arm with a releasable fastener, such as a Velcro fastener.

Accordingly, it is an object of the invention to provide a new self defense glove type mechanism mounting a plurality of spikes which may be aimed at different directions during use and may be aimed in a single forward direction when not in use.

Other objects and advantages of the invention will be apparent from the following detailed description and the accompanying drawings.

BEST MODE FOR CARRYING OUT THE INVENTION

Figure 1:
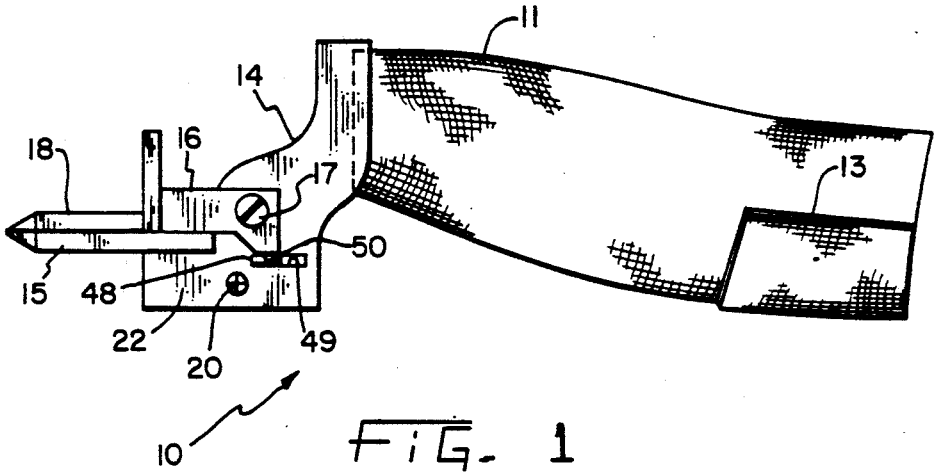
FIG. 1 is a side elevational view of a self defense weapon according to the invention with the projecting spikes all aimed forward.
Figure 2:
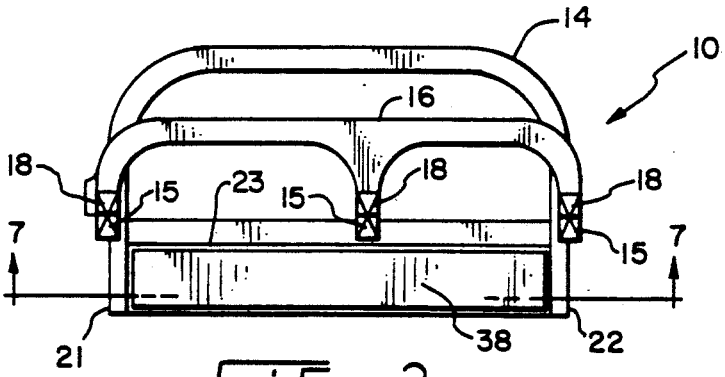
FIG. 2 is a front elevational view of the self defense weapon of FIG. 1.
Figure 3:
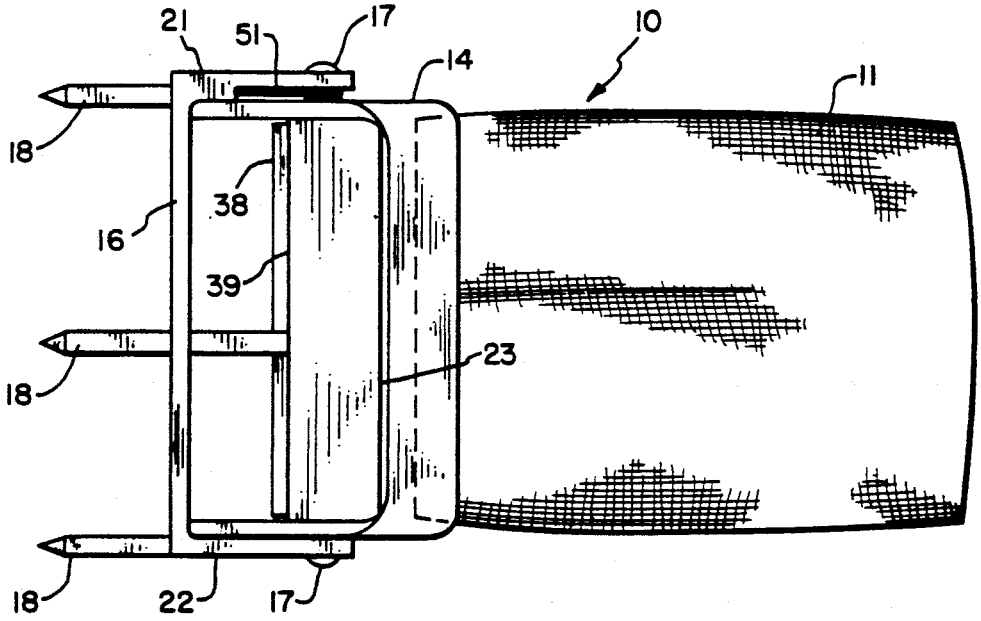
FIG. 3 is a top plan view of the self defense weapon of FIG. 1.

Referring to FIGS. 1–5 of the drawings, a self defense weapon 10 is illustrated according to the invention. In FIGS. 1–3, the weapon 10 is shown in a retracted or stored position and in FIGS. 4 and 5 the weapon 10 is shown in the use position. The weapon 10 is generally in the form of a glove 11 having a fabric portion 12 shaped to fit over the hand and wrist of a user. A releasable fastener 13, such as a Velcro fastener, may be located for securing about the users wrist to retain the weapon 10 on the users hand.

The weapon 10 has a head or handle 14 which rigidly mounts a plurality of first spikes 15. The first spikes 15 are mounted to point substantially forward from the users hand and arm for stabbing an opponent. By mounting a plurality of spaced spikes 15 (three shown) on the head 14 to point in the same direction, less accuracy is required on the part of a user in stabbing a target and more damage may be caused when the target is struck. A U-shaped member 16 is pivotally secured to the head 14 by screws 17 or by other suitable means. A second plurality of spikes 18 are mounted on the U-shaped member 16 to extend in a direction generally radially from the screws 17. The U-shaped member is confined to pivot between a first position wherein the second spikes 18 are substantially parallel to the first spikes 15 and a second position wherein said second spikes 18 are substantially perpendicular to the first spikes 15. As is discussed in greater detail below, the second spikes 18 are normally held in the first position when the weapon 10 is not in use and are pivoted to the second position during use.

Figure 4:
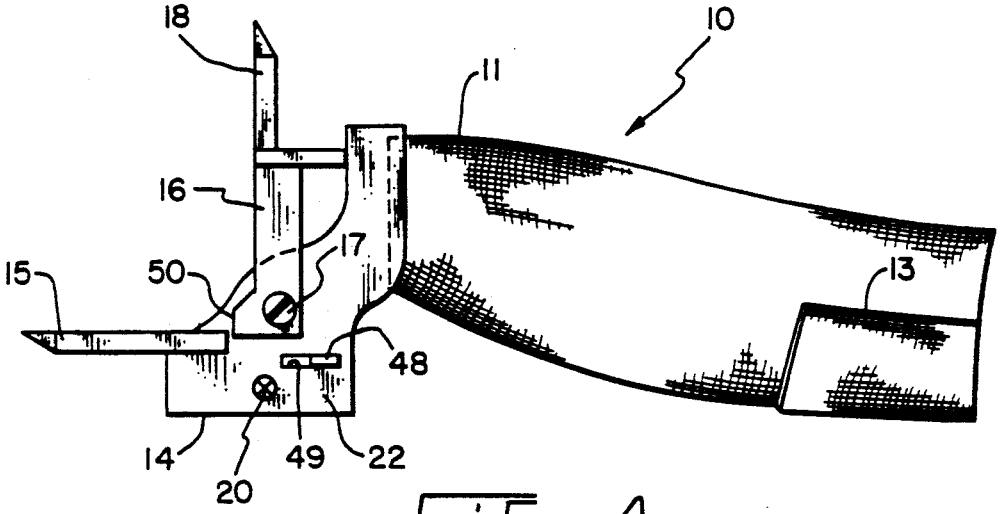
FIG. 4 is a side elevational view of the self defense weapon of the invention with the projecting spikes directed both forwardly, upwardly and outwardly for use.
Figure 5:
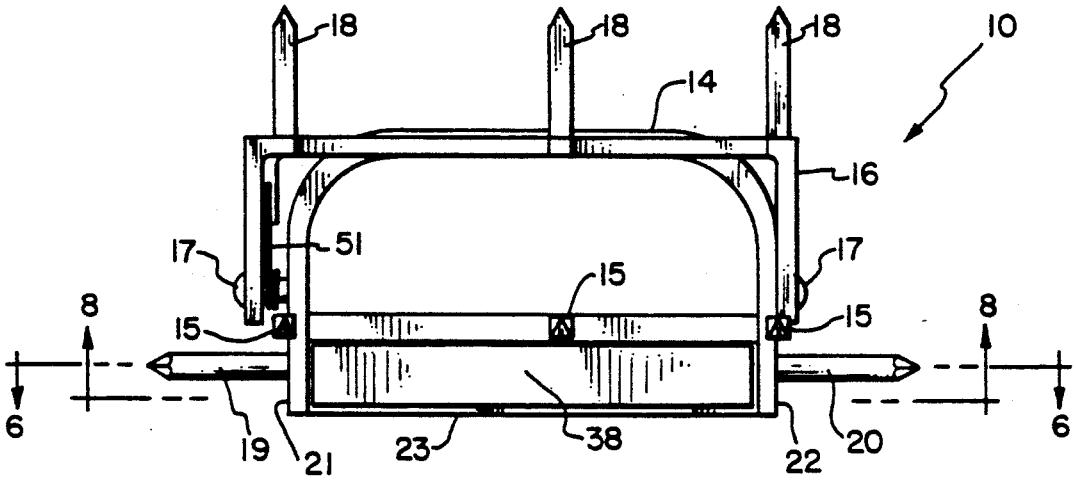
FIG. 5 is a front elevational view of the self defense weapon of FIG. 4.
Figure 6:
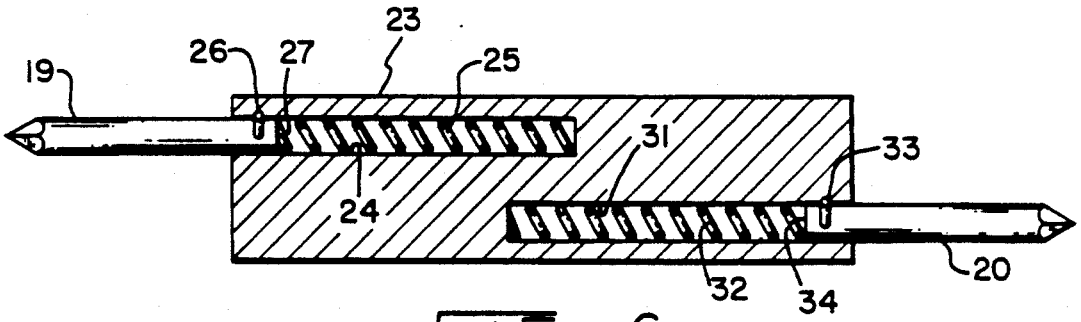
FIG. 6 is a cross sectional view taken along line 6—6 of FIG. 5.

A group of third or lateral spikes, two spikes 19 and 20 shown, are mounted selectively to be retracted into the head 14 (as shown in FIGS. 1–3) or to project laterally from opposite sides 21 and 22 of the head 14 (as shown in FIGS. 4 and 5). The lateral spikes 19 and 20 are mounted in a housing 23 which is secured to extend laterally across the head 14 for grasping by the user's fingers.

Details of the housing 23 and the mounting arrangement for the lateral spikes 19 and 20 are shown in FIGS.

Figure 7:
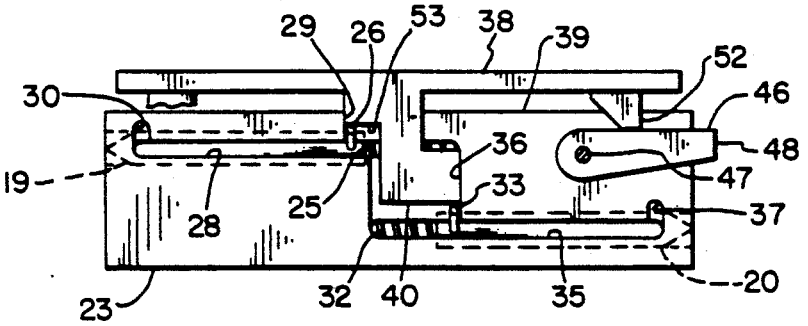
FIG. 7 is a cross sectional view taken along line 7—7 of FIG. 2.
Figure 8:
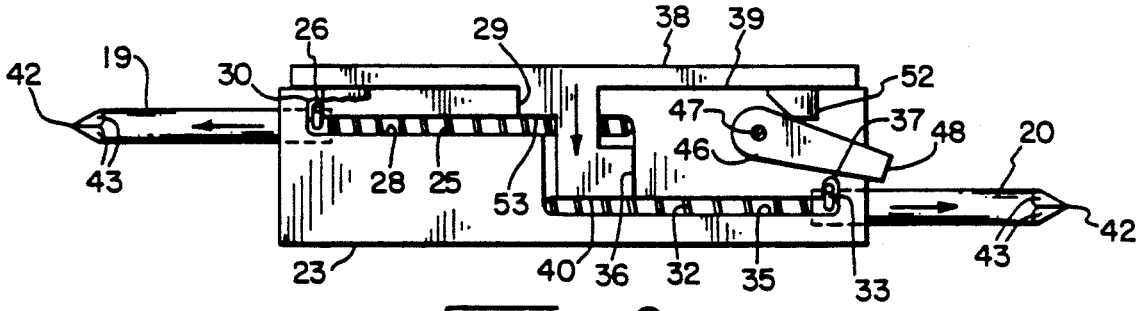
FIG. 8 is a cross sectional view taken along line 8—8 of FIG. 5.

6–8. The spike 19 slides in a passage 24 between the retracted position and the extended position. A spring 25 urges the spike 19 towards the extended position. A pin 26 extends laterally from adjacent an inner end 27 on the spike 19. The pin 26 is retained in a slot 28 for retaining the spike 19 in the housing passage 24. When the spike 19 is retracted into the passage 24 and rotated slightly, the pin 26 engages an inner stop 29 to hold the spike 19 in the retracted position, as is shown in FIG. 7. The spike 19 also may be rotated slightly when in the extended position until the pin 16 engages an outer stop 30 which locks the spike 19 in the extended position, as is shown in FIG. 8.

The spike 20 is similarly mounted in the housing 23. The spike 20 slides in an axial direction between retracted and extended positions in a passage 31 in the housing. A spring 32 urges the spike 20 towards the extended position. A pin 33 extends laterally from adjacent an inner end 34 on the spike 20 for engaging a housing slot 35. The pin 33 limits movement of the spike 20 between the retracted and extended positions. In the retracted position, the spike 20 may be rotated slightly until the pin 33 engages an inner stop 36 which holds the spike 20 in the retracted position, as is shown in FIG. 7. In the extended position, the spike 20 may be rotated slightly until the pin 33 engages an outer stop 37 which locks the spike 20 in the extended position, as is shown in FIG. 8.

An actuator 38 is mounted to extend along a forward face 39 on the housing 23 for engagement by the user's fingers (not shown). The actuator 38 is mounted to move into the housing 23 when squeezed. When the spikes 19 and 20 are locked in the retracted position, a surface 39 on the actuator 38 abuts the pin 26 and a surface 40 on the actuator 38 abuts the pin 33. As the actuator 38 is squeezed into the housing 23, the surface 39 pushes the pin 26 clear of the inner stop 29 and the spring 25 then snaps the spike 19 to the extended or projecting position. Simultaneously, the actuator surface 40 pushes the pin 33 clear of the inner stop 36 and the spring 32 snaps the spike 20 to the extended or projecting position.

Figure 9:
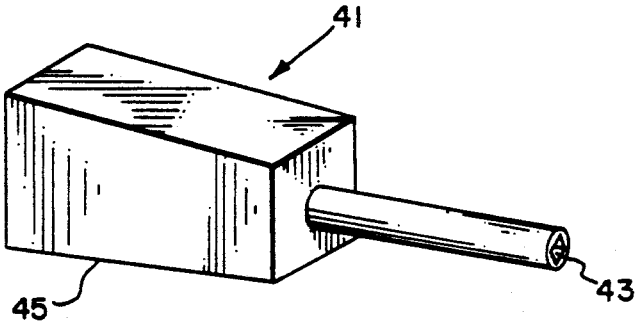
FIG. 9 is a perspective view of a tool for engaging and retracting the extended lateral spikes into the storage position.

As is illustrated in FIG. 9, a tool 41 may be provided for locking the spikes 19 and 20 in the extended position and for retracting and locking the spikes 19 and 20 in the retracted position. The spikes 19 and 20 are preferably provided with pointed ends 42 formed from a plurality of flat faces 43. The tool 41 has an end opening 44 which is shaped for engaging the pointed ends 42 and the faces 43. The tool 41 also has a handle end 45. When the tool end opening engages an end 42 on an extended spike 19 or 20, the spike 19 or 20 may be rotated to either lock the spike in the extended position or to release the spike. When an extended spike 19 or 20 is released, the tool handle 45 may be pushed and turned to lock the spike 19 or 20 in the retracted position.

As is shown in FIGS. 1, 4, 7 and 8, a latch 46 is mounted on the housing 23 to pivot on a pin 47. The latch 46 pivots between a first position shown in FIGS. 1 and 7 and a second position as is shown in FIGS. 4 and 8. The latch 46 has an end 48 which projects from a slot 49 in the head 14. While the latch 46 is in the first position, a flange 50 on the U-shaped member 16 engages the latch end 48 and retains the member 16 in the stored or first position. When the latch 46 is pivoted to the second position, the member 16 is free to pivot and a spring 51 causes the member 16 and the attached second group of spikes to pivot to the second position. A tab 52 is provided on the actuator 38 for moving the latch 46 from the first position to the second position when the actuator 38 is squeezed.

Initially, the weapon 10 is secured to a user's arm and is in the stored position wherein the lateral spikes 19 and 20 are retracted and the second spikes 18 are directed forward next to the first spikes 15. When the user squeezes the actuator 38, the second group of spikes 18 are released and rotated by the spring 51 from the forwardly directed position to a position substantially perpendicular to the first spikes 15 and the third spikes 19 and 20 are released and are moved by the springs 25 and 32, respectively, to extend laterally from opposite sides of the weapon 10. If desired, a safety (not shown) may be provided for inhibiting movement of the actuator 38 unless the safety is released.

It will be appreciated that various modifications and changes may be made in the above described preferred embodiment of the weapon 10 without departing from the spirit and the scope of the following claims.

I claim:

1. A self defense weapon comprising a glove type mechanism to fit on a users hand, a first plurality of spikes secured to said mechanism to extend in a direction generally forward from the users hand, a second plurality of spikes secured to said mechanism to pivot between a first position substantially parallel to said first spikes and a second position, substantially perpendicular to said first spikes, and a third plurality of spikesextending in a direction lateral to said first and second spikes.

2. A self defense weapon, as set forth in claim 1, and further including means mounting said third spikes to each move between a first position of the third spikes wherein said third spikes are retracted into said weapon and a second position of the third spikes wherein said third spikes are extended from said mechanism.

3. A self defense weapon, as set forth in claim 2, and further including spring means mounted to bias each of said third spikes towards its second position.

4. A self defense weapon, as set forth in claim 3, and further including means for releasably holding said third spikes in their first position, and actuator means responsive to a predetermined movement of a users hand in said weapon for releasing said holding means whereby said third spikes become extended from said weapon.

5. A self defense weapon, as set forth in claim 4, and further including mean for retaining said second spikes in said first position while said third spikes are retracted.

6. A self defense weapon, as set forth in claim 5, and including means responsive to a user releasing said holding means for simultaneously pivoting said second spikes to said second position.

7. A self defense weapon, as set forth in claim 6, and including tool means for moving said third spikes from their second position to their first position.

8. A self defense weapon, as set forth in claim 2, wherein said plurality of third spikes includes two third spikes which when extended extend from opposite sides of said weapon.

* * * * *